United States Patent [19]

Giroux

[11] Patent Number: 5,007,492

[45] Date of Patent: Apr. 16, 1991

[54] SAFETY STABILIZER FOR AUGER

[76] Inventor: Patrick C. P. Giroux, 902 Port Union Road, West Hill, Ontario M1C 2L9, Canada

[21] Appl. No.: 517,341

[22] Filed: May 1, 1990

[30] Foreign Application Priority Data

May 1, 1989 [CA] Canada ..... 599194

[51] Int. Cl.[5] ..... E21B 7/20

[52] U.S. Cl. ..... 175/170; 175/220; 175/203; 175/121; 175/113; 173/33; 173/39; 173/42

[58] Field of Search ..... 175/162, 170, 195, 51, 175/113, 121, 122, 203, 220; 52/157, 158, 159; 173/140, 30, 33, 18, 38, 39, 25, 42, 45

[56] References Cited

U.S. PATENT DOCUMENTS

| | | | |
|---|---|---|---|
| 31,468 | 2/1861 | Manley et al. | 175/113 |
| 72,497 | 12/1867 | Eles . | |
| 4,116,284 | 9/1978 | Cox | 175/170 |

*Primary Examiner*—Ramon S. Britts
*Assistant Examiner*—Roger J. Schoeppel

[57] ABSTRACT

A safety stabilizer for an auger having a screw, and an engine, and handles, and having two stabilizer legs, swingable upper joints on each leg, and anchors on the lower end of each leg.

8 Claims, 2 Drawing Sheets

SAFETY STABILIZER FOR AUGER

FIELD OF THE INVENTION

The invention relates to safety stabiliser apparatus for an auger of the type used for drilling post holes and the like in the ground.

BACKGROUND OF THE INVENTION

Power-operated augers are well known for drilling holes such as post holes for posts, fences, gates and the like. Such augers are based on a design consisting of an elongated auger screw, and a gasolene-powered engine connected to the auger screw through a centrifugal clutch and reduction gear. Such augers are provided with a pair of handle bars, by means of which two persons may hold the auger in position. When the engine is operating, it generates substantial reactive torque. Two persons are usually required to hold the handle bars on opposite sides of the engine, and resist this reactive torque. In this way, the power from the engine is transmitted through the clutch and reduction gear to the auger screw itself, causing it to be driven into the ground.

It is well known that this type of work can be both exhausting and, at times, hazardous.

If, for example, the engine is being operated at full throttle, and the auger screw hits a large structure such as a stone, it generates a sudden shock, causing a substantial increase in the reactive torque. Persons holding the handle bars in these circumstances may, in fact, be unable to prevent the handle bars from rotating. Alternatively, such persons are sometimes actually swung around due to the sudden increase in torque.

Even when the auger screw is operating smoothly without obstructions, there are other factors to be considered.

As the auger screw descends further into the earth, the handle bars and the motor will also descend. This means that the two persons holding the handle bars must gradually bend further and further down, until they are even kneeling or sitting, depending upon the depth of the hole being drilled.

This involves the persons adopting an awkward posture, particularly in view of the strenuous nature of the work involved.

When the hole is drilled to the desired depth, the engine is then throttled back, and the auger screw is withdrawn. This involves the two persons holding the handles bars exerting themselves to physically pull the auger screw, now ladened with earth, out of the hole. As mentioned, the engine is still running at this point, since if it was allowed to stop, the screw would simply bind solid in the hole. Accordingly, the engine is still at this point developing reactive torque, and is in fact attempting to penetrate further into the ground. It is also at the bottom of its hole, and therefore the handles will be close to the ground. The two men at this point have to both resist the reactive torque, and pull the rotating auger screw out of the hole, overcoming the pull of the screw attempting to continue to bore further into the ground. All of this must be done when bent almost double. This again is an exhausting and difficult task, even for two strong men.

BRIEF SUMMARY OF THE INVENTION

With a view to overcoming the various problems and disadvantages noted above, the invention comprises a safety stabiliser apparatus for an auger of the type having an auger screw, an engine and drive mechanism for operating said screw, and handle means extending to either side of said engine, said stabiliser apparatus, in turn, comprising rotatable and swingable upper joint means for attaching same to respective said handle means, support leg assemblies connected to respective said joint means, anchor means at the lower end of each said leg member adapted to engage the ground, said upper attachment means and said anchor means permitting movement of said leg member about a vertical axis and about a horizontal axis at said upper end relative to said handle attachment means, and at said lower end relative to the ground, whereby to allow said handle means on said auger to descend towards the level of the ground and to rotate, while said anchor means remains anchored in the ground.

More particularly, it is an objective of the invention to provide such a safety stabiliser apparatus for an auger, wherein said upper attachment means comprise clamping means for clamping around said handle means, said clamping means defining an upper and an underside, and said rotatable and swingable attachment means being secured to said underside of said clamping means, whereby to locate the upper end of said leg member below said handle means.

More particularly, it is an objective of the invention to provide such a safety stabiliser apparatus for an auger wherein said anchor means comprises a spike member, located at an angle to said leg member and adapted to be forced into the ground.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figures 1, 2:
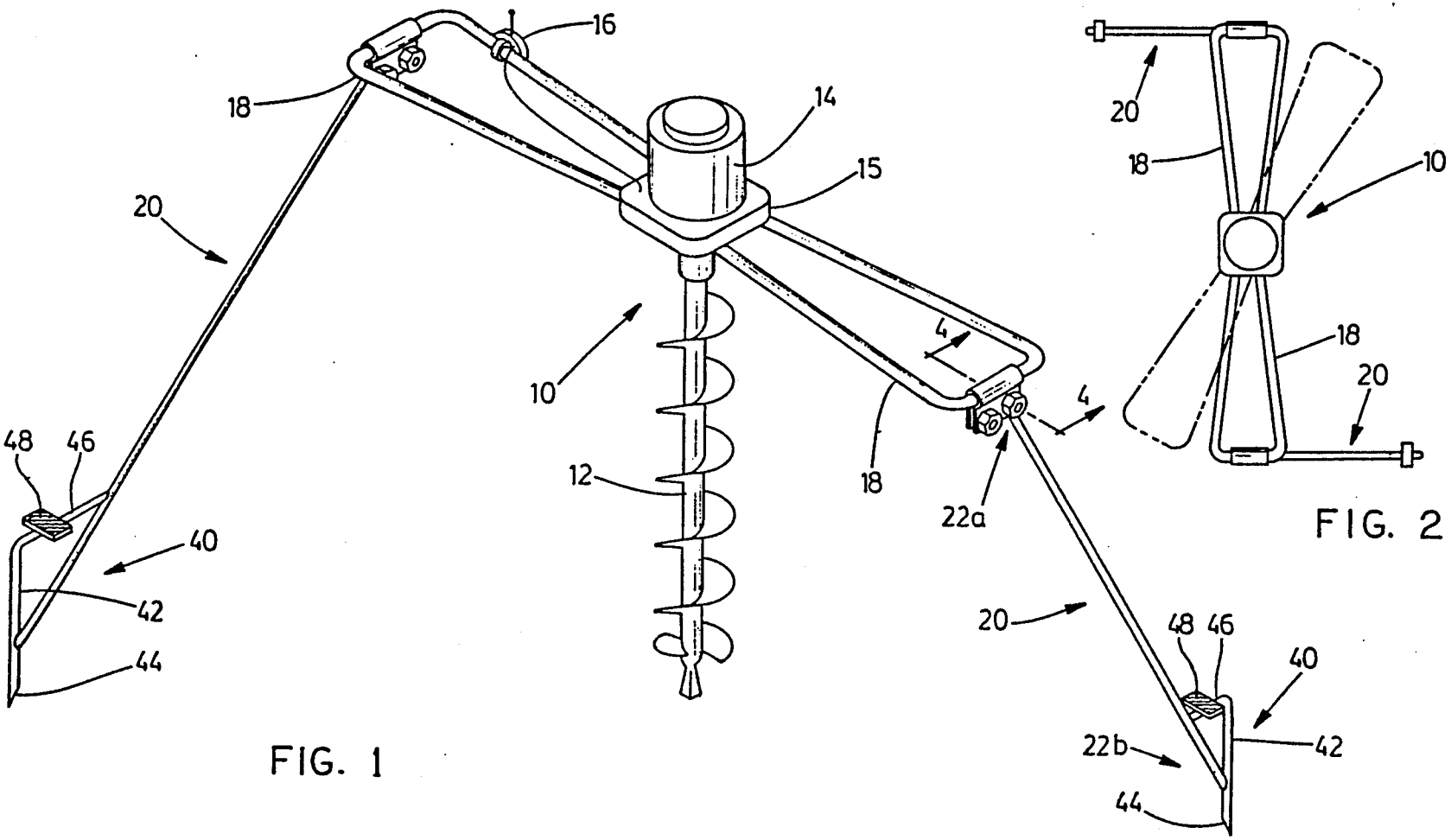
FIG. 1 is a perspective illustration showing an auger, and the safety stabiliser apparatus according to the invention attached thereto.
FIG. 2 is a schematic top plan view showing the manner of operation of the invention.
Figure 3:
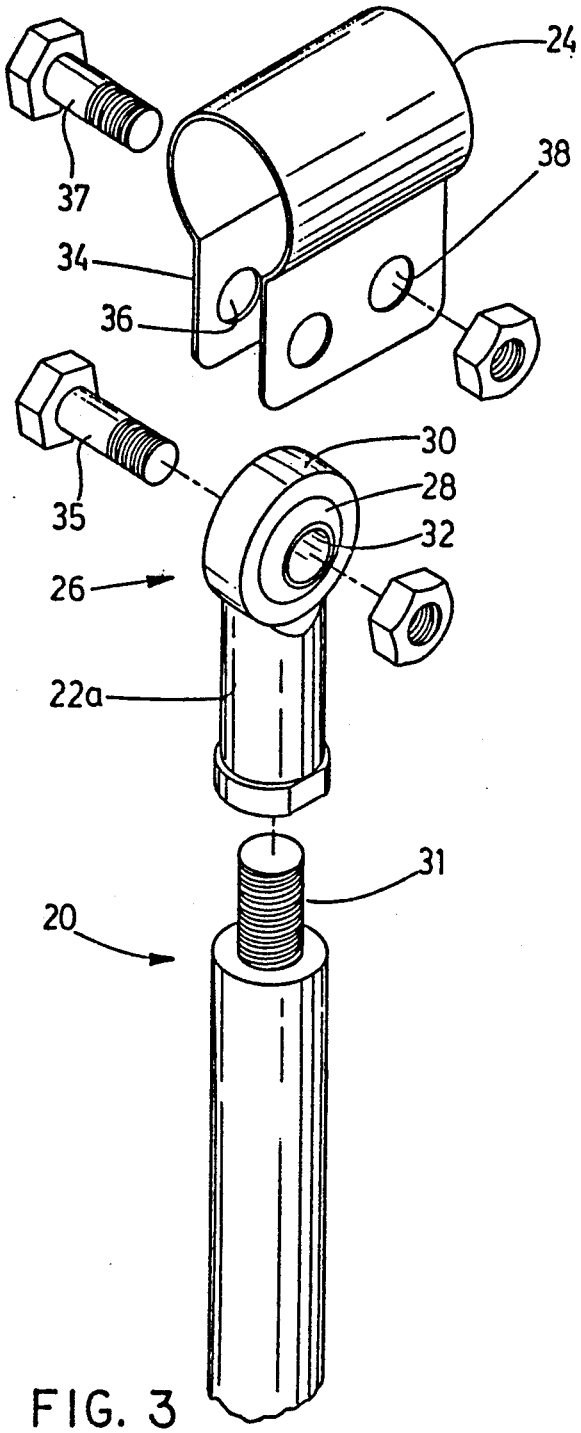
FIG. 3 is an enlarged perspective illustration of the upper end of a leg assembly of the safety stabiliser shown partially exploded.

Referring first of all to FIG. 1, the invention is illustrated in use in association with a typical auger indicated generally as 10. Such an auger 10 has an auger screw 12, and an engine, in this case a gasolene motor 14, operable to drive screw 12. Typically the engine 14 will be connected to screw 12 through a known clutch mechanism and reduction gear 15. Such clutch mechanisms are known as centrifugal clutches, and engage and disengage at a predetermined RPM of the motor 14.

The engine 14 may be controlled by means such as the throttle 16.

In order to guide the auger 10, it is provided with handle means, in this case in the form of a pair of handle bar loops 18—18. The handle bar loops 18, in this case, extend along radial axes at 180 degrees to one another. However, the invention is not restricted solely to augers having only two handle bar loops.

Such an auger 10 is operated by two men, who hold the two handle bar loops 18—18. The engine 14 is started, and the two men then brace themselves against the ground, and the throttle 16 is gradually opened to increase the engine speed. As the clutch engages at a predetermined RPM, it will commence driving the screw 12. The screw 12 will then be driven into the ground, thereby boring a cylindrical hole in the ground, for reception of an article such as a fence post, gate post, or the like.

As has been explained above, the work of operating such an auger is strenuous and, in some cases, hazardous. When the screw 12 hits a rock, it will usually stop abruptly. The clutch will not disengage immediately, and consequently a violent shock is transmitted through the handle bar loops 18 to the two men who are supporting them.

In addition, as the screw 12 bores further and further into the ground, the handle bar loops 18 will descend towards the surface of the ground. This will then mean that the two men holding them must also either crouch or kneel down, and adopt a posture which is generally awkward for the task involved.

When the auger screw 12 has reached its intended depth, the throttle 16 is eased back. The two men must then physically drag the auger 10, together with its load of earth on the screw 12, up out of the hole. During this lifting operation, the engine is still running at reduced speed and driving the screw. As a result there is both reactive torque, which must be resisted, as well as a certain degree of downward thrust created by the rotation of the auger screw, and thus the two men must both lift the entire weight of the auger and its load, and also resist the reactive torque, and also overcome the downward thrust of the screw itself. This can be the most strenuous part of the task.

In accordance with the invention, the safety stabiliser apparatus comprises leg assemblies 20—20, one for each of the handle bar loops. Each of the stabiliser leg assemblies 20 will be seen to comprise upper and lower leg portions **22*a*–22*b*. Each upper leg portion 22*a* has at its upper end a handle bar clamp 24. The clamp 24 is adapted to be releasably clamped around the handle bar loop 18 of the auger 10**.

The clamp 24, on its underside, is connected to upper leg portion **22*a* by rotatable and swingable joint means 26. Joint means 26 provides what is in effect a limited universal joint connection between the upper leg portion 22*a* and the handle bar loop 18. This is so as to permit the leg portion to both swing downwardly and upwardly, and also to swing through a limited sideways arc relative to the handle bar loop 18**.

The joint means 26 also locates the upper end of the leg below the plane of the handle bar loop 18, for reasons to be described below.

Figure 4:
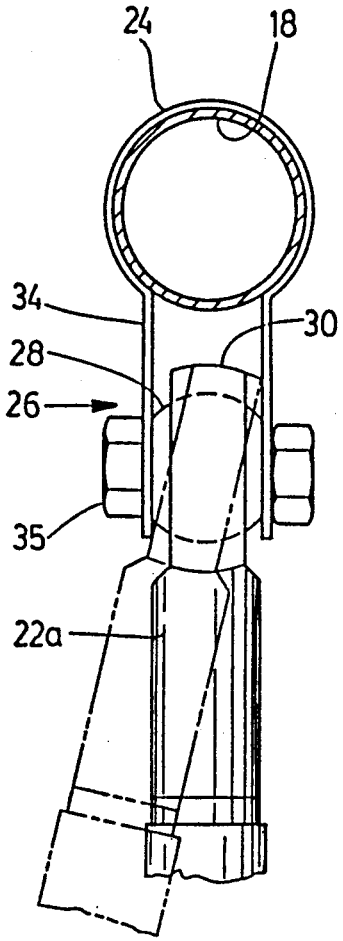
FIG. 4 is a sectional illustration of a leg assembly along the line 4—4 of FIG. 1, and, FIG. 5 is a cut-away perspective of an alternate embodiment.

The joint means 26 will be seen to comprise a ball joint device consisting of a ball 28 and a ring 30 encircling ball 28. Ring 30 is rotatable around ball 28, and also swingable thereto (FIG. 4).

Ring 30 is secured by any suitable means, e.g., welding, to the upper end **22*a* of the leg assembly. Upper end 22*a* may be integral with the entire leg assembly 20, but in this embodiment is connected by threaded connection means 31. Ball 28 has a central opening 32, and is secured between flanges 34 of clamp 24, by means of bolt 35, passing through holes 36. A second bolt 37 passing through holes 38 in flanges 34 secures the clamp 24 to handle bar loop 18**.

Holes 38 are closer to handle bar 18, and holes 36 are further away. In this way, bolts 37 can be made tight around handle bar loop 18, while leaving clearance between ring 30 and flanges 34.

The lower end **22*b* of each leg assembly 20 is provided with an anchor device 40 (FIG. 1) for securing it to the ground. Anchor device 40 comprises a spike 42 secured about midway along its length to lower end 22*b* of leg 20. Anchor device 40 will be at an angle of about 45 degrees to leg 20 and has a point at its lower free end 44. At its upper end, a cross-bar 46 is integrally formed, and cross bar 46 has a free end secured to leg 20. A foot plate 48 is secured to bar 46. Legs 22** may be provided in various different lengths for different designs of auger, if desired.

In operation, the stabilisers are attached to the handle bar loops 18 in the manner shown in FIG. 1. This is achieved by opening up the clamps 24 and then closing them around the handle bar loops 18 and clamping them in position with bolts 37. When clamped, the handle bar loops 18 cannot rotate within the clamps 24. The joint assemblies 26 are attached to the flanges 34 of the clamps 24 by bolts 35. The clamps 24 are located with the swingable joint means 26 being located beneath the handle bar loops 18 for reasons to be described below.

The legs 22 are then swung to either side of the axis of the auger screw 12 in a diagonal fashion, in which they are opposed to the reactive torque generated by the operation of the auger. Thus, as shown in FIG. 1, the screw 12 will be rotating clockwise, and the reactive torque generated will cause the handle bar loops 18—18 to attempt to rotate anti-clockwise. The angling of the leg assemblies 20—20 will thus resist this anti-clockwise reactive torque. The anchor devices 40 are placed with the spikes 42 planted in the ground. By stamping or foot pressure on plates 48, the spikes 42 are driven into the ground.

The engine 14 is then started, with either the two men holding the handle bar loops 18, or in many cases only one man holding one of the handle bar loops, so as to control the orientation of the auger screw 12.

The trottle 16 is then operated to accelerate the engine 14, and the auger screw 12 will thus rotate and drive itself into the ground. The reactive torque will be resisted by the stabilisers. Thus, all the operator or operator has to do is control the engine speed, and also to guide the auger screw, so that it is maintained on a desired, e.g., vertical axis, assuming the post hole is to be drilled vertical. In order to do this, he may from time to time need to close the throttle and release one or both of the anchors and rearrange the alignment of the auger screw, and then plant the anchor(s) and spike(s) back back in the ground.

As the auger screw 12 bores further into the ground, the handle bar loops 18 will descend closer to the surface. As they do so, it will be apparent that the stabilisers will cause the handle bar loops to rotate about the axis of the auger screw, and relative to the anchor plates 40 (FIG. 2). The joint means 26, at the top end of the leg portions 22, will permit the leg portions 22 to gradually adopt a more and more inclined or angled position and, at the same time, will permit the handle bar loops 18 to rotate away from the anchors 40.

At the lower ends of legs 22, the spikes 42 will readily permit rotational movement, i.e., about a vertical axis. As the legs 22 swing down closer to the ground, the spikes will also have to tilt in the ground. In practice, this takes place easily with little resistance. Even when the legs 22 are at ground level, i.e., at or near horizontal, the spikes are still at about 45 degrees to the ground and thus provide a secure anchor.

FIGS. 2 and 4 illustrate the sideway swinging movement of the legs relative to the anchor means which will accommodate this rotational movement. It will be appreciated that the invention, by providing a predetermined spacing between the flanges 34, and 42, and the rings of the joint means, allows for a limited degree of swinging movement around the respective balls, thereby facilitating this movement.

When the desired depth of borehole has been achieved, the thottle is eased back and the men may then simply grasp the handle bar loops 18, and pull the auger screw out of the hole. In addition, by swinging or rotating the handle bar loops 18 in the reverse direction, i.e., towards the anchors 40, the stabiliser apparatus will assist in levering the auger screw 12, and its load of earth, up out of the borehole.

This will eliminate the necessity for the two men from overcoming the reactive torque of the engine while the auger screw is pulled out, and will substantially reduce the physical effort required for lifting the loaded auger.

The location of the joint means 26 on the underside of the clamp 24 is a significant feature of the invention. If, for any reason, one of the legs or joints should fail, then that leg will simply fall downwardly out of the way.

Figure 5:
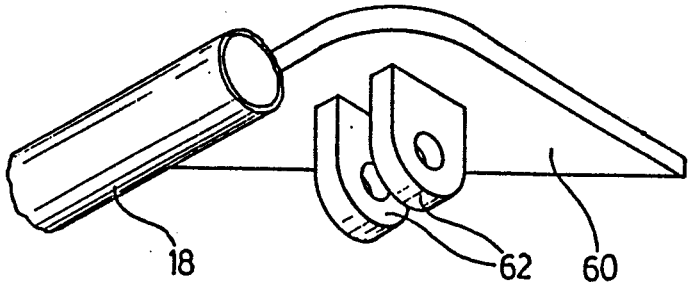

In an alternate embodiment of the invention, the clamps 24 may be replaced by plates 60 (FIG. 5). Plates 60 are welded to handles 18 inside the loop of the handle bar loops 18. Flanges 62 on plates 60 extend downwardly, for attachment of the joint means 26 of upper ends *22a*.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A safety stabiliser apparatus for an auger of the type having an auger screw, an engine and drive mechanism mounting on top the auger for operating said screw, and at least two handle means extending to either side of said engine, said stabiliser apparatus, in turn, comprising:

rotatable and swingable upper joint means and means for attaching same to respective said handle means;

support leg assemblies connected to respective said joint means, each said assembly including a leg member having an upper end and a lower end, and, anchor means at the lower end of each said leg member adapted to securely engage the ground, said anchor means rotatable and swingable relative to the ground, said upper joint means and said anchor means thereby permitting movement of said leg member about both a vertical axis and a horizontal axis relative to said handle means, and relative to the ground, thereby to allow said handle means on said auger to descend towards the level of the ground and to rotate relative to the axis of said auger while said anchor means remains anchored in position on the ground.

2. A safety stabiliser apparatus as claimed in claim 1 including clamping means for clamping around said handle means, said clamping means defining an upper and an under side, and said rotatable and swingable upper joint means being secured to said under side of said clamping means, thereby to locate tne upper end of said leg member below said handle means.

3. A safety stabiliser apparatus as claimed in claim 2 wherein said anchor means comprises a spike member, secured to said leg member at an angle.

4. A safety stabiliser apparatus as claimed in claim 3 including foot plate means on said anchor means for applying foot pressure thereto.

5. A safety stabiliser apparatus as claimed in claim 1, wherein said means for attaching said upper joint means comprises plate members adapted to be secured to said handle means, and lug means on the said plate members.

6. A safety stabiliser apparatus as claimed in claim 1, wherein said upper joint means comprises a partially spherical body, an opening therethrough and a ring member defining partially spherical interior surfaces engaging said body.

7. A safety stabiliser apparatus as claimed in claim 6, including clamping means having two clamping flanges, and openings therein, and fastening means passing through said opening means, and through said body.

8. A safety stabiliser apparatus as claimed in claim 6, including plate members adapted to be secured to said handle means, and lug means thereon and openings in said lug means and fastening means passing through said openings and through said body.

* * * * *